US008616491B2

(12) United States Patent
Smith

(10) Patent No.: US 8,616,491 B2
(45) Date of Patent: Dec. 31, 2013

(54) PAPER ROLL HOLDER

(76) Inventor: Lance B. Smith, San Lorenzo, CA (US)

( * ) Notice: Subject to any disclaimer, the term of this patent is extended or adjusted under 35 U.S.C. 154(b) by 430 days.

(21) Appl. No.: 12/904,343

(22) Filed: Oct. 14, 2010

(65) Prior Publication Data

US 2012/0091251 A1 Apr. 19, 2012

(51) Int. Cl.
*B65H 16/06* (2006.01)
*B65H 18/04* (2006.01)

(52) U.S. Cl.
USPC ..... 242/596.4; 242/596.7

(58) Field of Classification Search
USPC ..... 242/596, 596.1, 596.3, 596.4, 596.5
See application file for complete search history.

(56) References Cited

U.S. PATENT DOCUMENTS 1,913,363 A * 6/1933 Allen ..... 242/596.4
2,948,486 A * 8/1960 Epeneter ..... 242/596.4
4,043,519 A * 8/1977 Suzuki et al. ..... 242/596.4
4,553,710 A * 11/1985 Pool ..... 242/596.4
5,253,818 A * 10/1993 Craddock ..... 242/596.4
5,868,347 A * 2/1999 Paul et al. ..... 242/596.4
6,198,828 B1 * 3/2001 Kuo ..... 381/71.11
6,286,781 B1 * 9/2001 Lai ..... 242/596.4
6,386,478 B2 * 5/2002 Reilly ..... 242/596.4
6,837,455 B2 * 1/2005 Eckhard et al. ..... 242/596.4
2001/0015395 A1 * 8/2001 Reilly ..... 242/596.4
2003/0189126 A1 * 10/2003 Hale ..... 242/596.4

* cited by examiner

*Primary Examiner* — William E Dondero

(57) ABSTRACT

A paper roll holder formed of a base plate for mounting to a vertical or horizontal surface; two-spaced apart side plates mounted perpendicularly to the base plate; each comprising a slot for mounting a pivoting peg therein and two mounting holes penetrating by a dowel pin; the pivoting peg further comprising a sloped, elongated groove formed in a top surface of the peg to allow the mounting of a torsion spring therein, and a mounting hole in the end with the deep groove, and a dowel pin penetration the two mounting holes in the side plate, the mounting in the pivoting peg and an aperture through a center of the torsion spring.

3 Claims, 5 Drawing Sheets

PAPER ROLL HOLDER

FIELD OF THE INVENTION

The present invention generally relates to a paper roll holder and more particularly, relates to a toilet paper holder and paper towel holder that ease the task of changing and replacing toilet paper rolls.

BACKGROUND OF THE INVENTION

The present invention relates generally to roll paper holders and particularly, to paper roll holders, and more particularly, to a toilet paper holder or paper towel holder having automated pivotal support pegs with machined tapered open pivotal cavities/channel/grooves, on side plates with open pivotal cavities/channel grooves which serve the triple purpose of providing a tensioning base means for the paper roll pivotal support pegs, an open pivotal cavity/channel groove for the displacement of the paper roll pivotal support pegs and an open pivotal cavity/channel/groove without a basin for sanitary purposes, by means of eliminating the build-up of particle matter which exists in mechanisms having pivotal paper roll support arms. As a roll of toilet paper or paper towel is inserted into the pivotal side peg dispenser, the paper roll causes the pivotal support pegs to pivot up into the open pivotal cavities/channel grooves, which in turn automatically ejects the spent roll of toilet paper or paper towel, until the pivotal support pegs under tensioning means, return to the extended position upon encountering the hollow area of the roll, all being completed with one hand. The present invention eliminates the build up of particle matter by having open-ended pivotal cavities/channel grooves without basins, which are accessible for ease of cleaning. The open pivotal cavities/channel grooves not only add to the aesthetics and fluidity of the operation but will also eliminate the introduction and build up of particle matter, resulting in a sanitary paper roll dispenser.

It is therefore an object of the present invention to provide a well working sanitary toilet paper holder and paper towel holder in which the paper rolls can be easily and quickly exchanged with one hand.

It is another object of the present invention to provide a toilet paper holder and paper towel holder that eliminates the need for a compressible support tube for supporting paper rolls.

It is a further object of the present invention to provide a toilet paper holder and paper towel holder that has pivotal side pegs mounted inside the side plate without visible hinges or support structures.

It is another further object of the present invention to provide a toilet paper holder and paper towel holder that has an open ended pivotal cavity that allows for the ease of cleaning and eliminates the build up of particle matter.

SUMMARY OF THE INVENTION

In accordance with the present invention, a toilet paper holder and paper towel holder is provided.

In a preferred embodiment, the present invention paper holder a base plate for mounting to a vertical or horizontal surface; two-spaced apart side plates mounted perpendicularly to the base plate; each comprising a slot for mounting a pivoting peg therein and two mounting holes penetrated by a dowel pin; the pivoting peg further comprising a sloped, elongated groove formed in a top surface of the peg to allow the mounting of a torsion spring therein, and a mounting hole in the end with the deep groove, and a dowel pin penetrates the two mounting holes in the side plate, the mounting in the pivoting peg and an aperture through a center of the torsion spring.

BRIEF DESCRIPTION OF THE DRAWINGS

The invention will now be described, by way of example, with reference to the accompanying drawings, in which.

DETAILED DESCRIPTION OF THE PREFERRED EMBODIMENT

The present invention discloses a paper roll holder that can ease the task of changing and replacing paper rolls.

The present invention paper roll holder is an improved toilet paper holder or paper towel holder that is sanitary, ease to use, clean and aesthetically pleasing. The present invention includes a wall plate and two side plates extending from the wall plate. Each of the side plate includes machine open pivotal cavities/channel grooves adapted to receive pivotal pegs. Both side pivotal pegs rests securely inset of the mechanical open pivotal cavities/channel grooves to allow the pivotal peg to pivot upwardly without impeding to exchange the paper rolls as well as ease the cleaning and eliminate the build up of particle matter. The wall plate, side plate and pivotal pegs can be made of a virtually any suitable material such as wood, metal, Plexiglas, carbon fibers, fiberglass and plastic measuring 2½ inches high, 3½ inches long, and either 6½ inches wide or 13 inches wide. This allows for easy wall-mounting and can accommodate a roll of paper. The present invention features two spring loaded pegs that extend outward from the side of the holder. For use, the consumer simply removes the old roll and then presses the new roll upward against the spring-loaded pegs placing it into position onto the roll. The holder can be produced from metal, wood, plexiglas, carbon fibers, fiberglass, or plastic and in a wide variety of colors to match the décor of any bathroom. As a variation, the present invention can be produced in a multiple roll holding version.

The present invention paper roll holder fulfills the need for an improved paper holder that allows a person to remove and replace an empty roll with ease. The appealing features of the present invention are its convenience, efficiency, ease of use, durability, attractiveness, effectiveness, and practicality. With the present invention, an empty roll of paper can easily be removed and placed with a new roll in a matter of seconds. The present invention can be easily operated by children, adults, and the elderly. It provides convenient access to toilet tissue when needed. It features a modernized design that eliminated the time-consuming task of removing the entire rod to replace a roll of toilet tissue. The specifically designed, spring-loaded holder makes it easier and more convenient to use.

Figure 1:
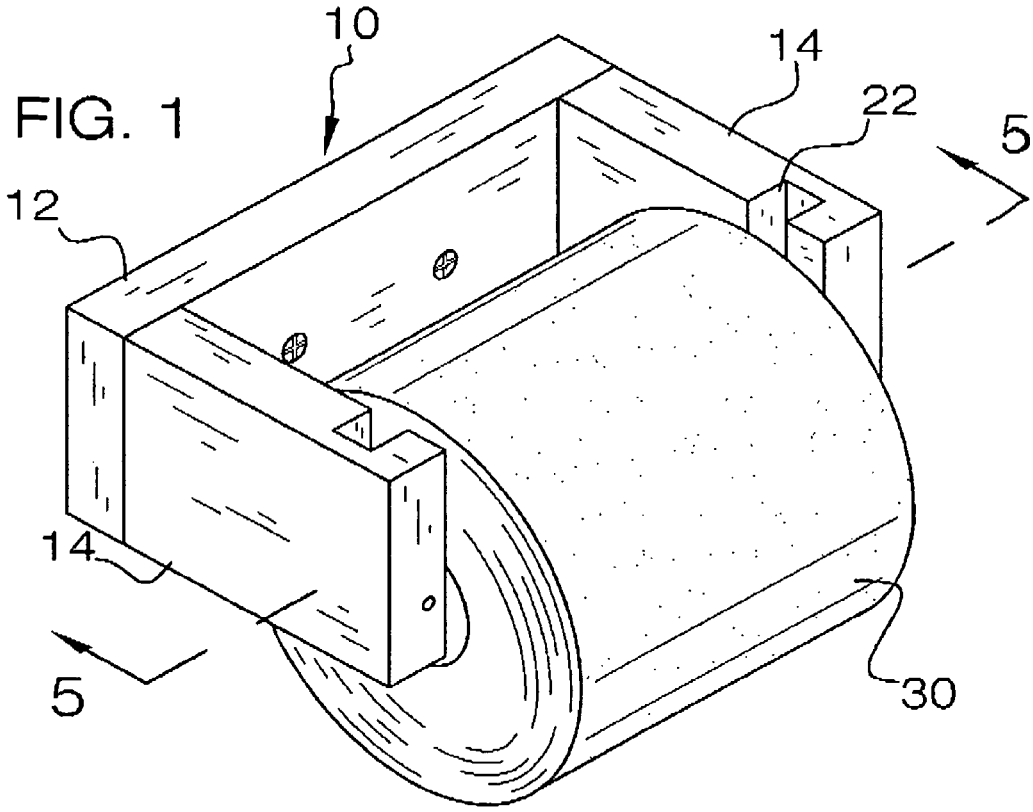
FIG. 1 is a perspective view of the present invention paper roll holder with a roll of rolled paper.

Referring initially to FIG. 1, wherein the paper roll holder 10 is shown. The present invention includes a rectangular base plate 12 secured horizontally or vertically to any selected surface, such as a wall, cabinet or a shelf in accordance with conventional fastening techniques. Two side plates 14 extend perpendicularly from the base plate 12. Each side plate 14 is fixedly secured to the base plate 12 on one side and houses a perpendicular pivotal peg 20 in the cavity/channel groove 22 which is held in place by a dowel pin 16. The open pivotal cavity/channel groove 22 allows the pivotal pegs 20 to pivot upwardly without impediment to exchange the paper rolls as well as ease of cleaning and the elimination of builds up of particle matter as the open pivotal cavity/channel groove 22 is open ended thus providing a sanitary paper dispenser.

Figure 2:
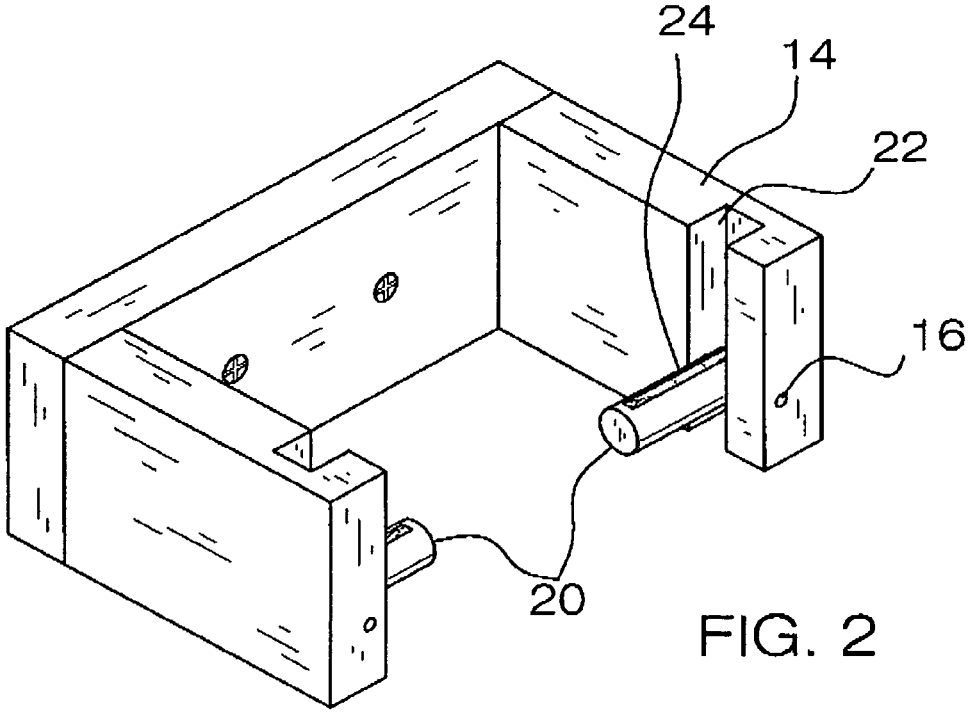
FIG. 2 is a perspective view of the present invention paper roll holder showing the pivotal pegs.

FIG. 2 is another perspective view of the holder 10 without a toilet paper roll 30. The side plate 14 which has a cavity/channel groove 22 running full length parallel to the edge, houses a pivotal peg 20 with machined tapered cavity/channel groove 24 and a torsion spring 40. The pivotal peg 20 has a tapered cavity/channel groove 24 tapering down from the tip 26 of the peg 20 and terminating at the opposite end 28 of the peg 20, to accommodate one of the torsion spring 40. The pivotal peg 20 and the torsion spring 40 are secured in the cavity/channel groove 22 with a dowel pin 16 penetrating through holes 18 and 48. These are shown in FIGS. 3 and 4.

Figure 3:
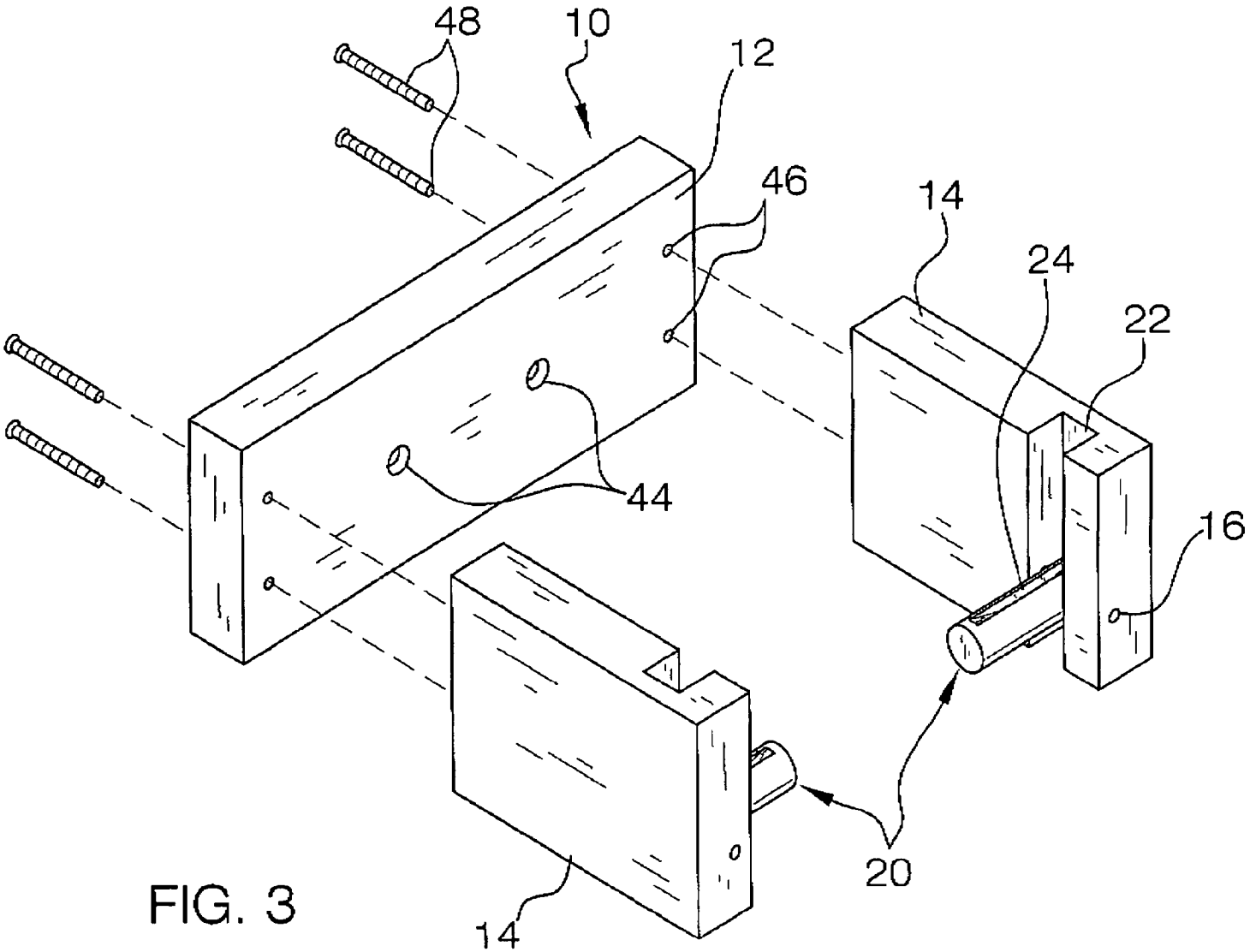
FIG. 3 is a cross-sectional view of the present invention paper roll holder.
Figure 4:
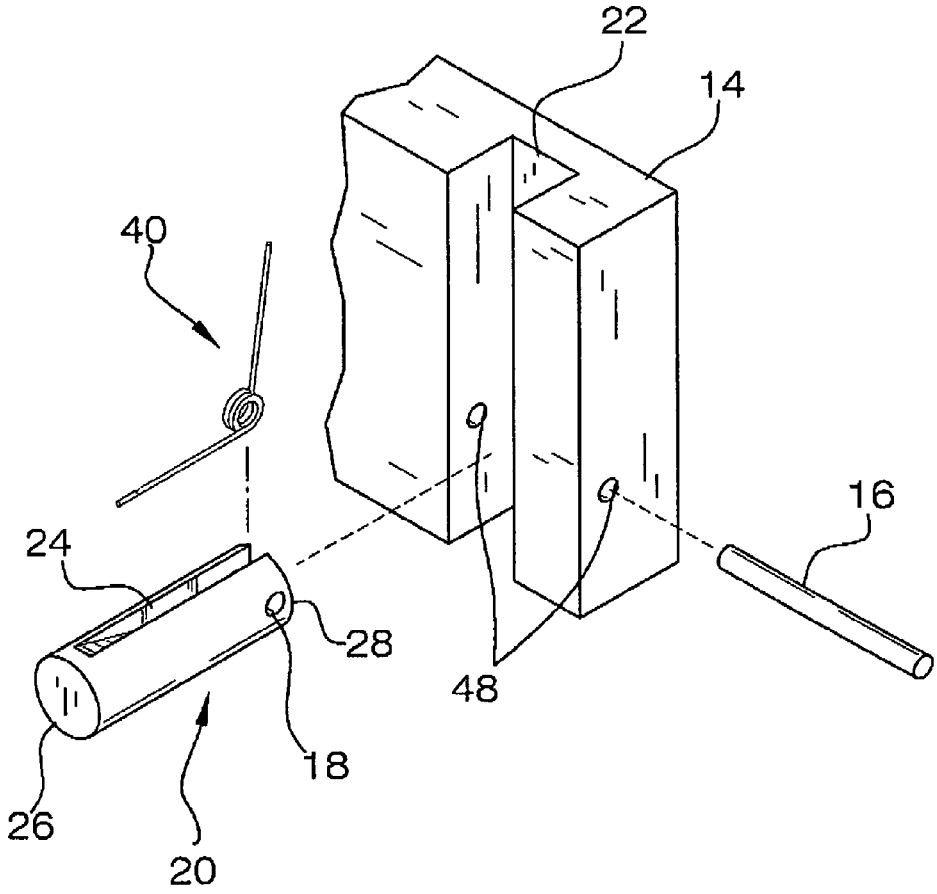
FIG. 4 is a cross-sectional view of the side plate illustrating the insertion of the pivotal peg.

FIG. 3 further shows mounting holes 44 for the mounting base plate 12 to a vertical or horizontal surface, and mounting holes 46 for mounting the side plates 14 to the base plate 12 by screws 48.

Figure 5:
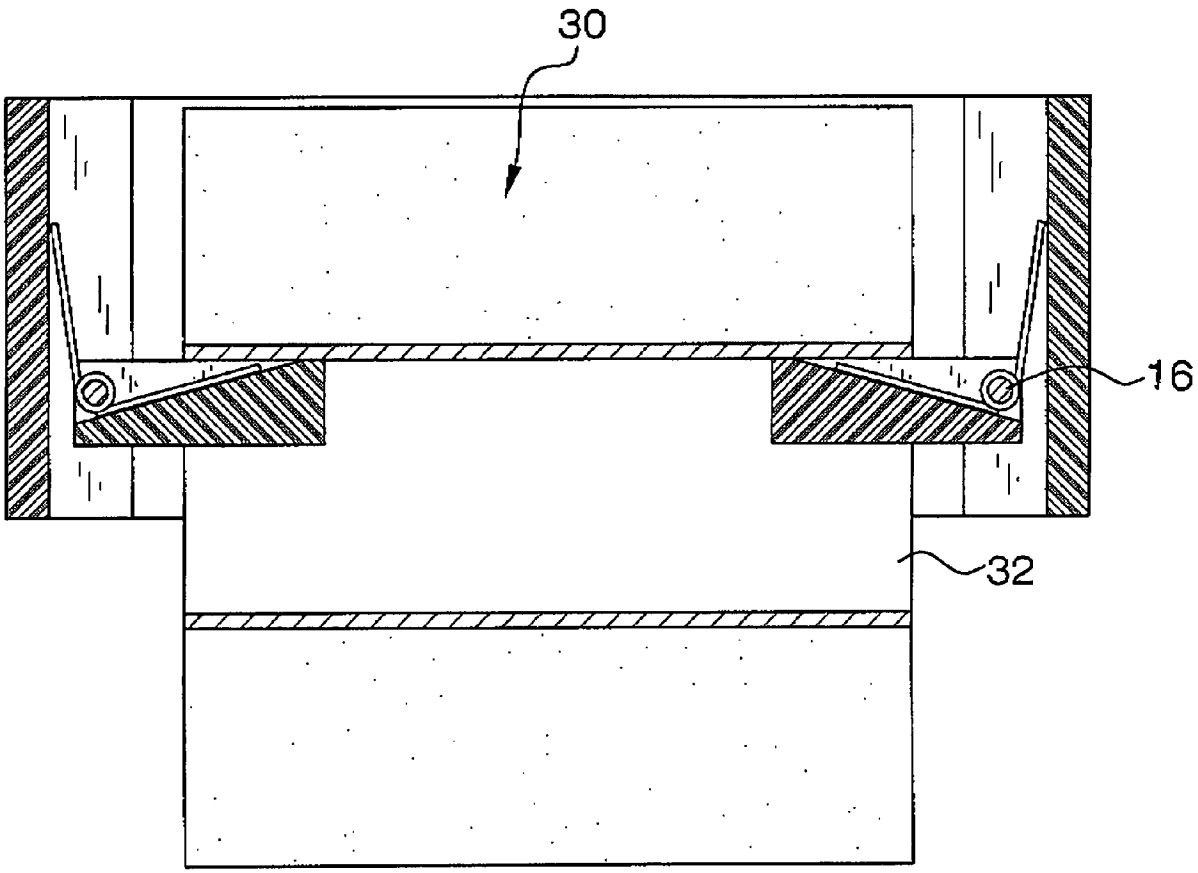
FIG. 5 is a cross-sectional view of the side plate with the paper installed.
Figure 6:
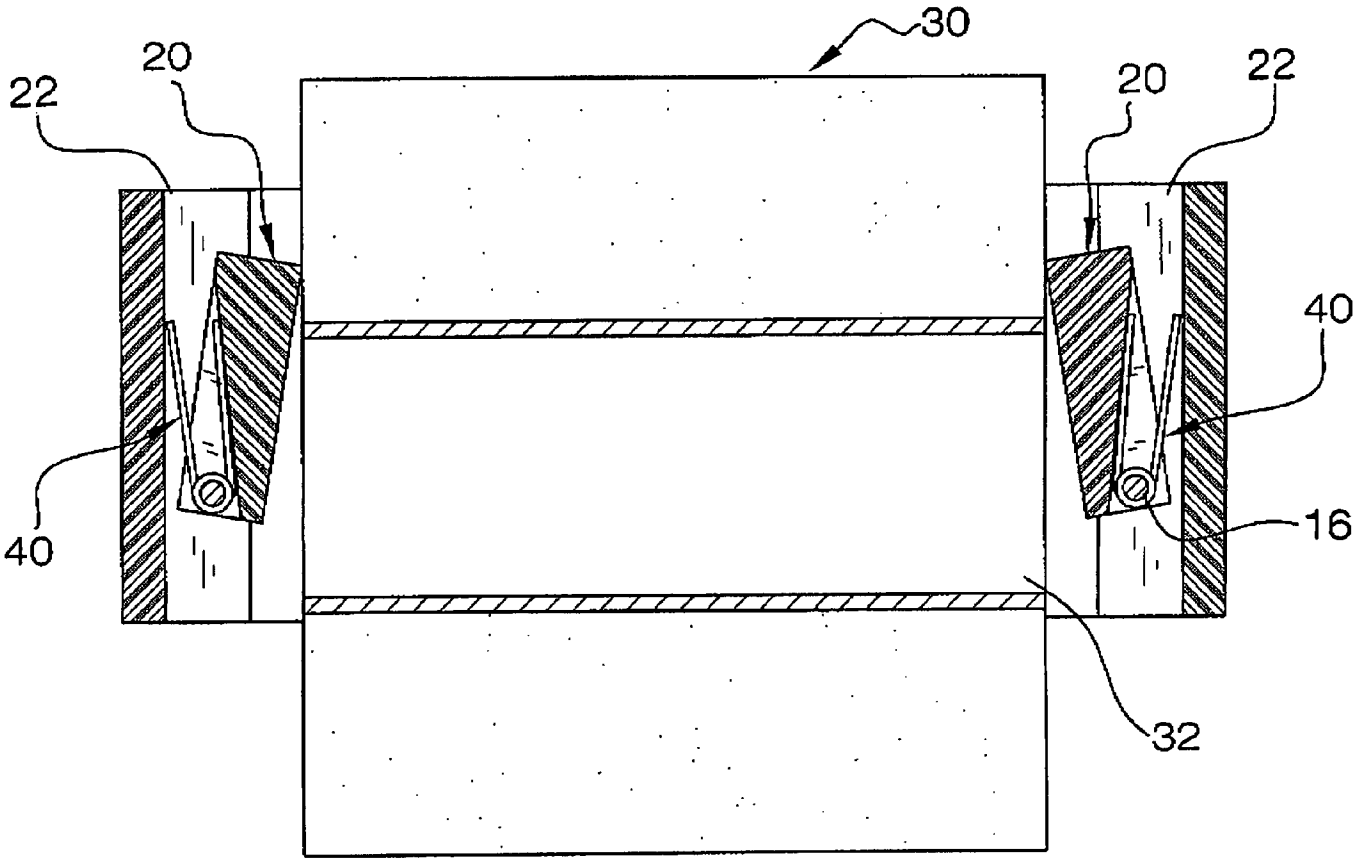
FIG. 6 is a cross-sectional view of the side plate simulating movement of the paper being installed.

FIGS. 5 and 6 are cross-sectional views shown taken through the center of the peg 20 and the side plate 14 with dowel pin 16 wherein the mounting of a paper roll 30 is shown. With the torsion spring 40 in an extended (or relaxed) position and the pivoting peg 20 in a down position holding the center core 32 of the paper roll 30, and the torsion spring 40 in a reacted (or compressed) position and the pivoting peg 20 in a lifted position before entering the center core 32 of the paper roll 30, the paper roll 30 can be either a toilet paper roll a paper towel roll.

While the preferred embodiments of the invention have been described above, it will be recognized and understood that various modifications can be made in the invention and the appended claims are intended to cover all such modifications which may fall within the spirit and scope of the invention.

What is claimed is:

1. A paper roll holder comprising:

a base plate for mounting to a vertical or horizontal surface;

two-spaced apart side plates mounted perpendicularly to said base plate; each comprising a slot for mounting a pivoting peg said rein and two mounting holes penetrating by a dowel pin;

said pivoting peg further comprising a sloped, elongated groove formed in a top surface of said peg for mounting of a torsion spring, and a mounting hole in an end with said deep groove; and said dowel pin penetrating said two mounting holes in said side plate, said mounting in said pivoting peg and an aperture through a center of said torsion spring.

2. The paper roll dispenser according to claim 1, wherein said base plate and pivoting pegs are formed of wood.

3. The paper roll dispenser according to claim 1, wherein said base plate and pivoting pegs are formed of plastic.

* * * * *